US005085429A

United States Patent [19]

Van Der Hoeven

[11] Patent Number: 5,085,429

[45] Date of Patent: * Feb. 4, 1992

[54] MUSCULATURE EXERCISING METHOD

[76] Inventor: Martin A. Van Der Hoeven, 3330 Carlsbad Blvd., Carlsbad, Calif. 92008

[ * ] Notice: The portion of the term of this patent subsequent to Oct. 30, 2007 has been disclaimed.

[21] Appl. No.: 603,454

[22] Filed: Oct. 25, 1990

Related U.S. Application Data

[63] Continuation-in-part of Ser. No. 395,537, Aug. 18, 1989, Pat. No. 5,005,832, and a continuation-in-part of Ser. No. 360,133, Jun. 1, 1989, Pat. No. 4,966,363, which is a continuation-in-part of Ser. No. 156,404, Feb. 16, 1988, Pat. No. 4,848,740.

[51] Int. Cl.[5] ..... A63B 23/02

[52] U.S. Cl. ..... 272/93; 272/118; 272/134

[58] Field of Search ..... 272/72, 73, 93, 117, 272/118, 123, 132, 134, 70, 143; 128/28 R; 73/379

[56] References Cited

U.S. PATENT DOCUMENTS

| | | | |
|---|---|---|---|
| 232,022 | 9/1880 | Gifford | 272/134 X |
| 1,577,809 | 3/1926 | Randall | 272/72 |
| 1,983,911 | 12/1934 | Luppert | 272/72 |
| 2,160,722 | 5/1939 | Cunningham | 272/70 |
| 3,491,751 | 1/1970 | Wolfing . | |
| 3,503,388 | 3/1970 | Cook . | |
| 3,558,130 | 1/1971 | Anderson | 272/72 |
| 3,741,538 | 6/1973 | Lewis et al. | 272/134 |
| 4,235,437 | 11/1980 | Ruis et al. | 272/134 |
| 4,261,562 | 4/1981 | Flavell | 272/129 |
| 4,290,597 | 9/1981 | Schleffendorf | 272/117 |
| 4,336,934 | 6/1982 | Hanagan et al. | 272/117 X |
| 4,398,713 | 8/1983 | Ellis | 272/145 |
| 4,428,577 | 1/1984 | Weingardt | 272/135 |
| 4,616,825 | 10/1986 | Anderson | 272/134 |
| 4,625,962 | 12/1986 | Street | 272/72 X |
| 4,637,608 | 1/1987 | Owen et al. | 272/134 |
| 4,653,750 | 3/1987 | McIntyre | 272/143 X |
| 4,666,151 | 5/1987 | Chillier | 272/118 X |
| 4,684,126 | 8/1987 | Dalebout et al. | 272/134 |
| 4,687,197 | 8/1987 | Larsson et al. | 272/72 |
| 4,702,108 | 10/1987 | Amundsen et al. | 73/379 |
| 4,725,055 | 2/1988 | Skowrodski | 272/134 |
| 4,725,056 | 2/1988 | Rehrl et al. | 272/134 |
| 4,725,057 | 1/1988 | Shifferaw | 272/134 X |
| 4,733,859 | 3/1988 | Kock et al. | 272/132 X |
| 4,757,998 | 7/1988 | Landin | 272/123 |
| 4,775,150 | 10/1988 | Graham | 272/143 |
| 4,802,462 | 2/1989 | Reiss et al. | 128/25 R |
| 4,858,919 | 8/1989 | Jones | 272/134 |
| 4,863,159 | 9/1989 | Brown, Jr. | 272/93 |
| 4,966,363 | 10/1990 | Van Der Hoeven | 272/93 |

FOREIGN PATENT DOCUMENTS

| | | |
|---|---|---|
| 3343634 | 6/1985 | Fed. Rep. of Germany . |
| 117935 | 8/1971 | United Kingdom . |

*Primary Examiner*—Robert Bahr
*Attorney, Agent, or Firm*—Henri J. A. Charmasson

[57] ABSTRACT

Methods for strengthening the musculature of the abdomen, upper legs and back. One method primarily consists of isometric contraction of the abdominal musculature while the operator is seated in a specific position in which the forearms are generally orthogonal to the arms, the arms are generally parallel to the thoracic spine, the legs are extended, the hip is flexed, the thoracic and lumbar spine are slightly flexed. The operator contracts the abdominal musculature while pulling the hands on a tensioned mechanism. Strengthening of the abdominal musculature is achieved by moving the abdomen against a resilient stop. Stationary and portable versions of the necessary apparatus are disclosed.

4 Claims, 3 Drawing Sheets

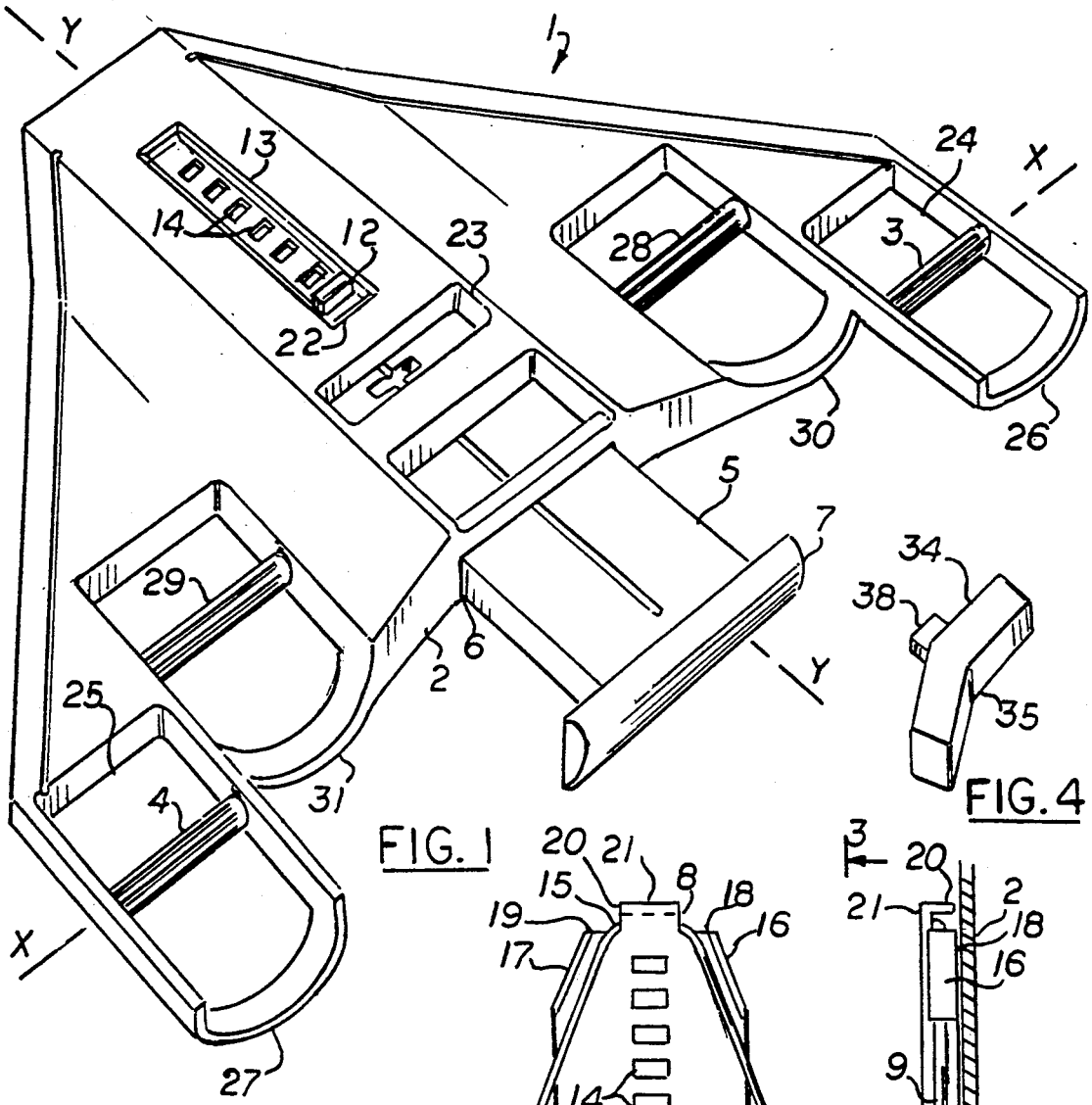
FIG. 1
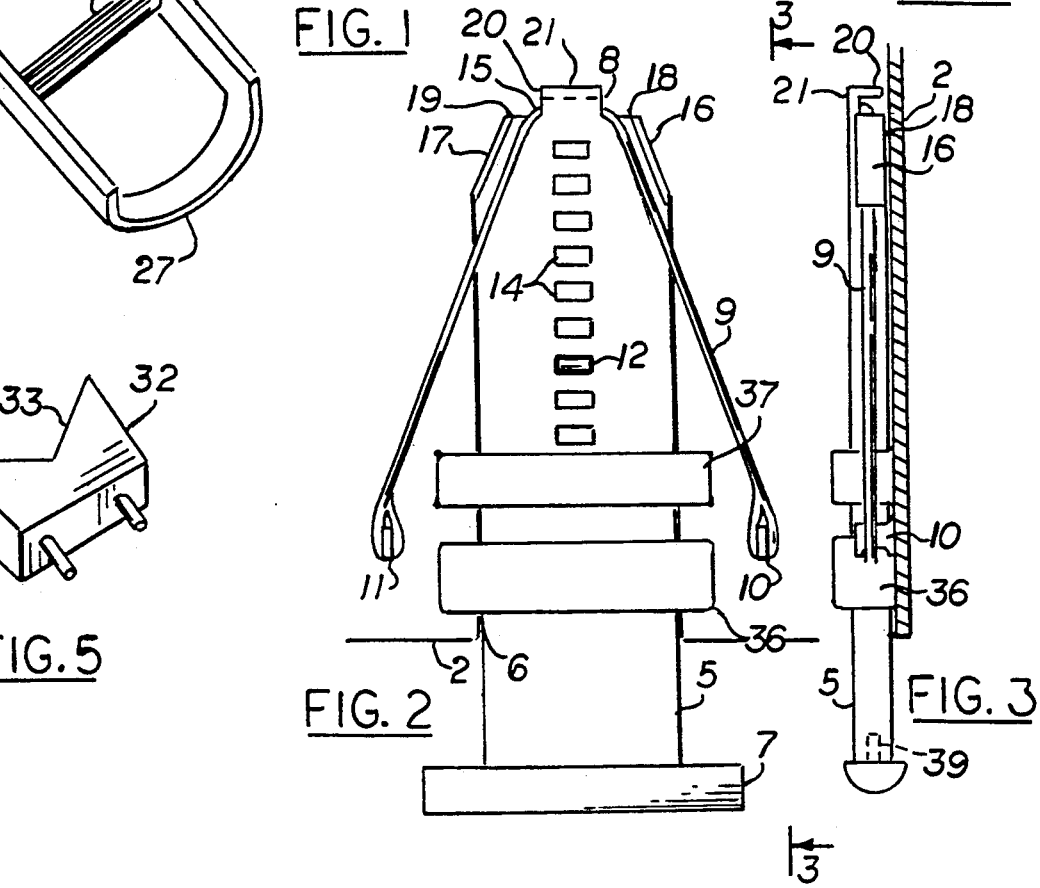
FIG. 4
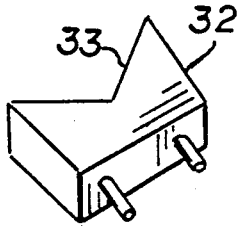
FIG. 5
FIG. 2
FIG. 3

MUSCULATURE EXERCISING METHOD

PRIOR APPLICATION

This is a continuation-in-part of applications Ser. No. 07/395,537 filed Aug. 18, 1989, now U.S. Pat. No. 5,005,832, and of Ser. No. 07/360,133 filed June 1, 1989, now U.S. Pat. No. 4,966,363, which was a continuation-in-part of Ser. No. 07/156,404 filed Feb. 16, 1988, now U.S. Pat. No. 4,848,740.

FIELD OF THE INVENTION

This invention relates to the increasingly popular field of body development and exercise activity for the purpose to increase tone, size, and definition of musculature. More specifically it relates to isometric exercise methods and devices for developing abdominal and glutaeus muscles.

BACKGROUND OF THE INVENTION

It is well-known that the abdominal and glutaeus muscles are difficult to isolate and strengthen. Many hours and years of exercise is generally necessary to produce significant effect on the abdominal musculature. The prior art discloses three categories of muscular development methods and apparatuses as follows:

full range of motion;

limited range of motion; and compression devices.

The full range of motion devices are typified in U.S. Pat. Nos. 4,290,597; 3,558,130; and 4,616,825. Each of these devices relates to a modification of the well-known sit-up exercises. Such inventions suffer from two major drawbacks. First, many muscle groups are indiscriminately exercised in addition to exercising of the target abdominal muscles. This results in slow development of the musculature. Second, the flexion of lumbar and thoracic spine over a significant range of motion may exacerbate previous low back and other injuries.

Limited range of motion inventions are typified by Schleffendorf, U.S. Pat. No. 4,290,597, generally involving an exercise called an "abdominal crunch." While such inventions may isolate the abdominal musculature, the positioning of the operator is such that maximal benefit to the operator is not achieved. The glutaeus maximus and glutaeus medius are even more difficult to isolate and exercise than the rectus abdominis and obliquus abdominis externus. There is no prior art apparatus known to the applicant dedicated to that purpose.

SUMMARY OF THE INVENTION

It is an object of the present invention to enable strengthening of the abdominal musculature without placing unnecessary stress upon the low back. This is achieved by isometric contraction process of the abdominal musculature which necessarily precludes excessive lumbar movement; and through the use of a novel type of apparatus which applies a resilient load against the abdomen while the subject is in a backward-tilted seating position, horizontally pulls with both hands a structure weighted in the opposite direction of the pull. A stationary and a portable version of the apparatus are disclosed. The portable apparatus can be modified for use as a glutaeus muscle exerciser, and can be used in a variety of standing, sitting and kneeling positions

BRIEF DESCRIPTION OF THE DRAWING

FIG. 1 is a perspective view of a portable musculature exerciser;

FIG. 2 is a partial bottom plan view thereof showing the resilient member mechanism;

FIG. 3 is a cross-sectional view taken along line 3—3 of FIG. 2;

FIG. 4 is a perspective view of an attachment for exercising the glutaeus muscles;

FIG. 5 is perspective view of a second attachment for positioning the exerciser against a convex corner structure;

DESCRIPTION OF THE PREFERRED EMBODIMENTS OF THE INVENTION

Figure 6:
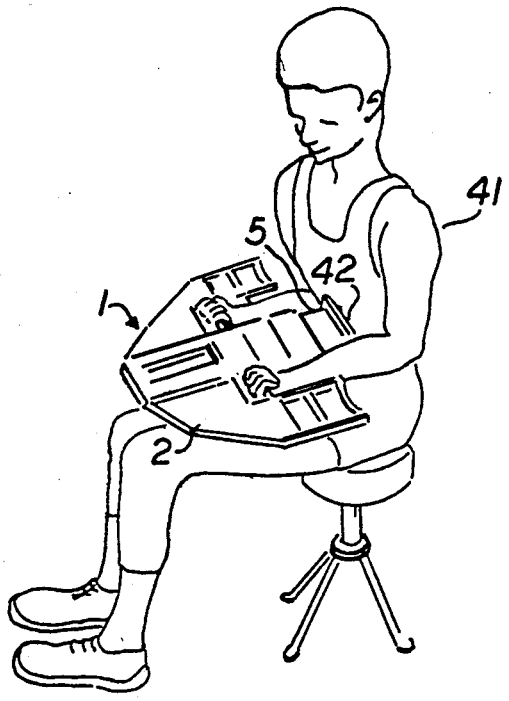
FIG. 6 illustrates the use of the exerciser for developing abdominal muscles.

Referring now to the drawing, there is shown in FIGS. 1-5 a portable musculature exerciser 1 which may be used in a variety of positions to exercise different parts of the human musculature. The exerciser comprises a generally triangular body forming a yoke 2. A pair of handles 3, 4 are positioned on opposite lateral ends of the yoke 2 and are aligned on the same transversal line X—X. An elongated member 5 is slidingly engaged into a channel passing through the center of the yoke in a direction perpendicular to the transversal line X—X. At the inner end of the member, a head 7 is shaped to provide a convenient bearing surface in contact with the user's body. The opposite end 8 of the member engages the median portion of an elastic cord 9 whose extremities are attached to a pair of anchoring posts 10, 11 projecting from the undersurface of the yoke 2 on opposite sides of the channel 6 and member 5. As the member 5 progresses into the channel 6, it stretches the elastic cord 9 which resiliently opposes the penetration of the member 5 into the channel 6. A pin 12 can be inserted through a window 13 in the upper surface of the yoke into one of a plurality of bores 14 located along the axis Y—Y of the member 5. The location of the bore 14 into which the pin 12 is inserted determines the force necessary to move the member 5 inwardly into the channel 6. As more specifically illustrated in FIGS. 2 and 3, the median portion 15 of the elastic cord 9 is captured between the two lateral flanges 16, 17 projecting downwardly from the upper forward ends 18, 19 of the member 5, and the end flange 20 projecting from the upper tip area 21 of the member 5.

The amount of penetration of the member 5 into the channel 6 from the rest position set by the pin 12 pressing against the inner edge 22 of the window 13 is limited by the length of the window 13. It may also be limited by inserting a second pin through the window 13 into another one of the bores 14. The member 5 may also be completely immobilized within the channel 6 by placing the pin 12 through the narrow window 23.

Each of the two handles 3, 4 spans the middle area of a channel 24, 25 bridged by arcuate inner strips 26, 27 forming convenient wrist supports for the comfort and safety of the user. A second set of handles 28 29 is positioned contiguously and inwardly from the first pair of handles 24, 25. The second set of handles 28, 29 has the same geometry as the first set and includes similar wrist supports 30, 31. The span between the two outer pair of handles 3, 4 is approximately 65 cm (26 inches). The span between the inner set of handles 28, 29 is approximately 35 cm (14 inches).

A nose piece 32 can be attached to the tip of the yoke. It provides an angular bearing surface 33 of 90 degrees aperture which can be positioned against the convex corner of a wall or door jamb when the exerciser is used with certain types of musculature development exercises. The head 7 at the inner end of the member 5 which is normally designed to bear against the abdomen of the user, as will be explained later, may be replaced by an alternate head 34 which has an angular bearing surface 35 with an aperture of 150–160 degrees. This alternate head is particularly adapted for contact with the hips and buttocks of the user during other types of musculature development exercises.

The entire yoke and handle assembly is formed as an integral body of plastic including the two brackets 36, 37 molded against the underside to engage and guide the movement of the sliding member 5. Each of the heads 7, 34 can be attached to the inner end of the member 5 by means of a tenon 38 which engages a mortise 39 in the sliding member 5. The weight of the entire portable exerciser 1 is approximately 1,250 grams (2.8 lbs).

A first use of the musculature exerciser 1 for developing the abdominal muscles is illustrated in FIG. 6. A user 41 assumes a seated position with forelegs substantially vertical. Keeping the spine in the erect position the user holds the exerciser by the pair of inner handles 28, 29 with his palms up, pulling the exerciser toward himself, until the head 7 bears against his abdominal area 42. He then holds his arms in a fixed position while he flexes his abdominal muscles causing the member 5 to reciprocally and resiliently move within the immobilized yoke 2.

Figure 7:
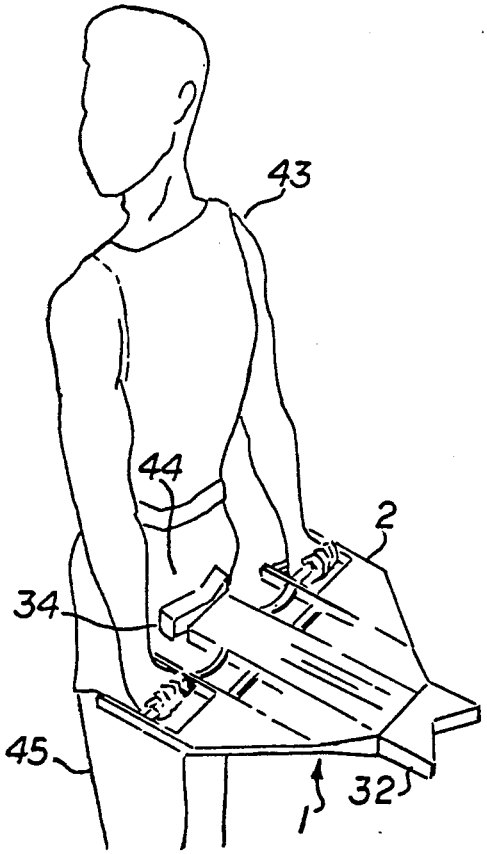
FIG. 7 illustrates the use of the exerciser for developing back and glutaeus muscles.

A second use of the exerciser 1 for developing the glutaeus and back muscles is illustrated in FIG. 7. The sliding member 5 is fitted with the alternate head 34. The user 43 holds the exerciser 1 behind him by the outer handles 3, 4 with his palms up and back erect. The bearing surface of the head 34 is brought against the left buttock 44, and the yoke 2 is maintained in a substantially horizontal position. The contoured nose piece 32 may be laid against a convex corner structure to stabilize the exerciser. Holding the exerciser immobile, the user flexes his glutaeus muscles to cause the member 5 to reciprocally and resiliently move within its channel. Contractions and relaxation of the glutaeus muscles can be effected by circular movements of the leg 45. A similar exercise can be practiced by positioning the head 34 against the right buttock after having rotated the head 180 degrees.

Figure 8:
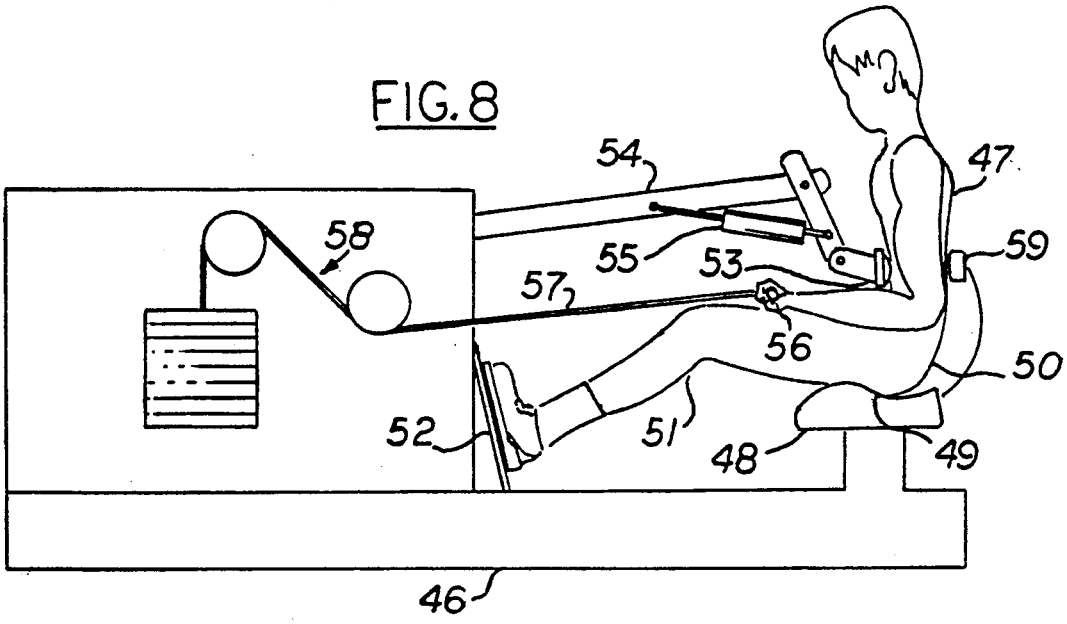
FIG. 8 illustrates the use of a stationary exerciser for the development of abdominal muscles.

Another method and a stationary apparatus 46 for the development of abdominal musculature are illustrated in FIG. 8. The user 47 sits on a seat 48 with a rearward slope 49 so that his pelvis 50 is slightly tilted backward. The legs 51 are extended in a substantially oblique position with the feet resting against a pair of vertical plates 52. The user leans his thorax forward and pushes his abdomen against a horizontally movable stop 53 pivotally mounted at the end of an arm 54. The stop is biased toward the use by a spring 55 or other resilient structure. The user then grabs a handlebar 56 attached to the end of a line 57 which is horizontally tensioned by a weight and pulley mechanism 58.

Figure 9:
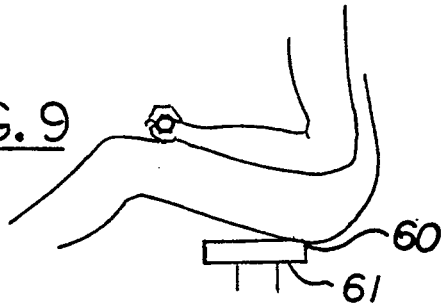
FIG. 9 illustrates an alternate seating position.

Pulling then holding the handlebar 56 immobile, with the forearms substantially horizontal and elbows against his ribs, the user flexes his abdominal muscles to move the stop 54 forward and backward against the spring 55. A back support 59 may be used to relieve back strain. The backward tilt of the pelvis may also be achieved by balancing the buttocks on the back edge 60 of a horizontal seat 61 as illustrated in FIG. 9. Further strengthening of the abdominal musculature may be achieved by the user's holding his breath in either the relaxed or tensioned state of his rectus abdominis.

What is claimed is:

1. A method for exercising one's abdominal musculature which comprises:

assuming a seated position with legs extended in an oblique direction;

pushing one's feet against a substantially vertical stop;

tilting one's pelvis posterially while resting the abdomen forwardly against a resiliently and horizontally movable barrier, and holding one's thoracic spine area in a forwardly bent position; and pulling and holding a horizontally tensioned tow-line with both hands, bringing one's arms to a substantially vertical position with elbows bent.

2. The method of claim 1 which further comprises the step of repeatedly contracting and relaxing one's abdominal muscles to move said barrier while holding said tension line.

3. The method of claim 2 which further comprises the step of holding one's breath during said contracting and relaxing.

4. The method of claim 3, wherein the step of tilting the pelvis comprises balancing one's hips over a back edge of a seat.

* * * * *